US009389634B2

(12) United States Patent
Washino

(10) Patent No.: US 9,389,634 B2
(45) Date of Patent: Jul. 12, 2016

(54) HELM DEVICE FOR BOAT

(71) Applicant: NHK SPRING CO., LTD., Yokohama-shi, Kanagawa (JP)

(72) Inventor: Keishi Washino, Yokohama (JP)

(73) Assignee: NHK SPRING CO., LTD., Yokohama-Shi, Kanagawa (JP)

( * ) Notice: Subject to any disclaimer, the term of this patent is extended or adjusted under 35 U.S.C. 154(b) by 0 days.

(21) Appl. No.: 14/632,765

(22) Filed: Feb. 26, 2015

(65) Prior Publication Data

US 2015/0166161 A1 Jun. 18, 2015

Related U.S. Application Data

(63) Continuation of application No. PCT/JP2013/074392, filed on Sep. 10, 2013.

(30) Foreign Application Priority Data

Sep. 13, 2012 (JP) ..... 2012-202018

(51) Int. Cl.

| | |
|---|---|
| ***G05G 5/04*** | (2006.01) |
| ***B63H 25/02*** | (2006.01) |
| ***B63H 20/12*** | (2006.01) |
| ***B63H 25/24*** | (2006.01) |

(Continued)

(52) U.S. Cl.

CPC ..... *G05G 5/04* (2013.01); *B63H 20/12* (2013.01); *B63H 25/02* (2013.01); *B63H 25/24* (2013.01); *B63H 25/52* (2013.01); *G05G 5/03* (2013.01); *B63H 2025/022* (2013.01)

(58) Field of Classification Search

CPC combination set(s) only.
See application file for complete search history.

(56) References Cited

U.S. PATENT DOCUMENTS 6,845,826 B1 * 1/2005 Feld ..... E21B 4/00 175/320
6,857,484 B1 * 2/2005 Helms ..... E21B 41/0085 175/57

(Continued)

FOREIGN PATENT DOCUMENTS

EP 1533211 A2 5/2005
EP 2330012 A1 6/2011

(Continued)

OTHER PUBLICATIONS

International Preliminary Report on Patentability (IPRP) including Written Opinion (in English) dated Mar. 26, 2015, issued in parent International Application No. PCT/JP2013/074392.

(Continued)

*Primary Examiner* — Nicole Verley
(74) *Attorney, Agent, or Firm* — Holtz, Holtz & Volek PC

(57) ABSTRACT

A stop mechanism of a helm device includes a rotation member, rotatable disks, fixed disks, and an electromagnet which presses these disks against one another. An inversion control pin is provided in a steering shaft. Slits are formed in a cylindrical portion. Both ends of the inversion control pin are inserted into the slits. The slits are shaped to be elongated in a circumferential direction of the cylindrical portion. A first pin receiving stopper wall is formed on one end of the slits. A second pin receiving stopper wall is formed on the other end of the slits. The inversion control pin can move within the range of inversion allowance angle between the pin receiving stopper walls.

6 Claims, 10 Drawing Sheets

(51) Int. Cl.
*B63H 25/52* (2006.01)
*G05G 5/03* (2008.04)

(56) References Cited

U.S. PATENT DOCUMENTS

| | | | | |
|---|---|---|---|---|
| 6,892,662 | B2 * | 5/2005 | Watanabe | B63H 20/12 114/144 R |
| 7,097,520 | B2 * | 8/2006 | Okumura | B63H 25/12 114/144 R |
| 7,137,347 | B2 * | 11/2006 | Wong | B63H 25/24 114/144 R |
| 7,140,315 | B2 * | 11/2006 | Okuyama | B63H 20/12 114/144 E |
| 7,168,383 | B2 * | 1/2007 | Saito | B63H 25/24 114/144 R |
| 8,281,728 | B2 * | 10/2012 | Washino | B63H 20/12 114/144 R |
| 8,794,169 | B2 * | 8/2014 | Harada | B63H 20/12 114/144 R |
| 2012/0045951 | A1 | 2/2012 | Washino et al. | |
| 2012/0137947 | A1 | 6/2012 | Harada et al. | |

FOREIGN PATENT DOCUMENTS

| | | | |
|---|---|---|---|
| JP | 02081298 | U | 6/1990 |
| JP | 10153271 | A | 6/1998 |
| JP | 2007203846 | A | 8/2007 |
| WO | 2011040154 | A1 | 4/2011 |
| WO | 2012023313 | A1 | 2/2012 |

OTHER PUBLICATIONS

International Search Report (ISR) dated Dec. 10, 2013 issued in International Application No. PCT/JP2013/074392.
Extended European Search Report dated Apr. 13, 2016, issued in counterpart European Application No. 13836895.6.

* cited by examiner

HELM DEVICE FOR BOAT

CROSS REFERENCE TO RELATED APPLICATIONS

This application is a Continuation Application of PCT Application No. PCT/JP2013/074392, filed Sep. 10, 2013 and based upon and claiming the benefit of priority from prior Japanese Patent Application No. 2012-202018, filed Sep. 13, 2012, the entire contents of all of which are incorporated herein by reference.

BACKGROUND OF THE INVENTION

1. Field of the Invention

The present invention relates to an electric helm device for use in steering a boat, and particularly, to a helm device comprising a stop mechanism which can apply resistance to the turning of a steering wheel.

2. Description of the Related Art

Conventionally, as a steering apparatus of an outboard motor, there has been known a steering apparatus comprising a hydraulic pump and a hydraulic actuator. A hydraulic pump is provided in a steering wheel (helm). A hydraulic actuator is disposed in an outboard motor and is driven by the hydraulic pump. In this type of steering apparatus, the direction of the outboard motor is changed by hydraulic pressure produced by the hydraulic pump. Also, a mechanical steering apparatus is known. In the mechanical steering apparatus, rotary motion of a steering wheel is transmitted to an outboard motor via a push-pull cable. Either type of steering apparatus is operated manually (i.e., by the boat operator's power). Accordingly, conventional steering apparatuses leave room for improvement in that a relatively large control force is required depending on the boat handling conditions.

Hence, electric steering apparatuses as disclosed in U.S. Pat. No. 7,137,347 (Patent Document 1) and WO 2012/023313A1 (Patent Document 2) have been contrived. An electric steering apparatus comprises a helm device comprising a sensor for detecting an operating angle of a steering wheel, and an actuator unit which is driven by electrical signals output from the helm device. In the electric steering apparatus, since the movement of a steering wheel is detected by a sensor, force for turning the steering wheel is extremely small. However, since it can even be dangerous for the steering wheel to be excessively turned with small force, resistance is applied to turning of the steering wheel by providing a friction mechanism in a helm unit. The friction mechanism comprises a plurality of fixed disks, a plurality of rotatable disks, and an electromagnet. The fixed disks and the rotatable disks are overlapped on one another alternately. The disks are composed such that they are pressed against one another by the electromagnet. Tooth portions formed on an outer peripheral portion of each of the fixed disks engage with a fixed spline member. Tooth portions formed on an inner peripheral portion of each of the rotatable disks engage with a rotatable spline member which rotates together with a steering shaft.

In the electric helm device, the steering wheel is locked by maximizing electric power to be supplied to the electromagnet to prevent the steering wheel from being turned further when it is operated to the maximum to the starboard or the port side. However, in order to turn the steering wheel to the opposite side, the aforementioned locked state must be cancelled. Accordingly, play is provided in an engagement portion between each tooth portion of the disk and the spline member.

In the conventional friction mechanism, play is provided in an engagement portion between each tooth portion of a disk and a spline member. In this case, if positions of all disks in the rotational direction are aligned with one another, the disks can be reversed within the range of the play relative to the spline member. However, due to vibration, etc., which is transmitted to a helm device during operation of the boat, positions of the respective disks in the rotational direction with respect to the spline member may be shifted from one another. In that case, the disks cannot be rotated relative to the spline member by the play. In order to solve the above problem, one idea was to provide an alignment mechanism for aligning the positions of the disks in the rotational direction, as described in Patent Document 2. However, a friction mechanism comprising such an alignment mechanism poses a problem that the structure becomes more complicated, and the number of components is increased.

BRIEF SUMMARY OF THE INVENTION

Accordingly, the present invention provides a helm device of a boat which can securely cancel the locked state in reversal of a steering shaft.

The helm device of one embodiment comprises a case secured to a hull (boat body), a steering shaft which is rotatably arranged in the case and on which a steering wheel is mounted, a sensor configured to detect rotation of the steering shaft, and a stop mechanism configured to stop rotation of the steering shaft when the steering wheel is turned to a maximum steering angle. The stop mechanism comprises a cylindrical portion which is relatively rotatable with respect to the steering shaft in a circumferential direction, and an inversion control pin mechanism. The inversion control pin mechanism includes an inversion control pin and first and second pin receiving stopper walls provided at both ends of a slit. The inversion control pin is provided in a radial direction of the steering shaft, extending through both the cylindrical portion and the steering shaft, and is secured to one of the steering shaft and the cylindrical portion. The slit is formed in the other one of the steering shaft and the cylindrical portion, and through which the inversion control pin is inserted to be movable in the circumferential direction. The first pin receiving stopper wall is formed on one end of the slit in the circumferential direction, and when the steering shaft rotates in a first direction, the first pin receiving stopper wall contacts the inversion control pin, thereby rotating the cylindrical portion in the first direction, and when the steering shaft rotates in a second direction, the first pin receiving stopper wall is separated from the inversion control pin by an angle which is greater than or equal to a minimum detection angle detectable by the sensor. The second pin receiving stopper wall is formed on the other end of the slit in the circumferential direction, and when the steering shaft rotates in the second direction, the second pin receiving stopper wall contacts the inversion control pin, thereby rotating the cylindrical portion in the second direction, and when the steering shaft rotates in the first direction, the second pin receiving stopper wall is separated from the inversion control pin by an angle which is greater than or equal to the minimum detection angle detectable by the sensor.

According to the embodiment, when the steering shaft which is locked at a maximum steering angle position is to be reversed, the inversion control pin moves from one of the pin receiving stopper walls to the other pin receiving stopper wall within the range of inversion allowance angle. Accordingly, reversal of the steering shaft can be detected by a sensor. The lock of the steering shaft by the stop mechanism can be cancelled. The inversion allowance angle can be adjusted by changing the diameter of the inversion control pin, or changing the distance between the first and second pin receiving stopper walls.

An example of the stop mechanism comprises a rotation member comprising the cylindrical portion, fixed disks accommodated in the case, rotatable disks arranged to be opposed to the fixed disks, respectively, and configured to rotate together with the rotation member, and an electromagnet which produces the frictional force by pressing the fixed disks and the rotatable disks against one another.

According to one embodiment, the inversion control pin is secured to the steering shaft, and the first and the second pin receiving stopper walls are formed on the cylindrical portion. According to another embodiment, the inversion control pin formed of a screw member is secured to the steering shaft, and the first and the second pin receiving stopper walls are formed on the cylindrical portion. Further, the inversion control pin may be secured to the cylindrical portion, and the first and the second pin receiving stopper walls may be formed on the steering shaft. Alternatively, the inversion control pin formed of a screw member may be secured to the cylindrical portion, and the first and the second pin receiving stopper walls may be formed on the steering shaft.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A boat comprising a helm device according to a first embodiment will now be described with reference to FIGS. 1 to 10.

Figure 1:
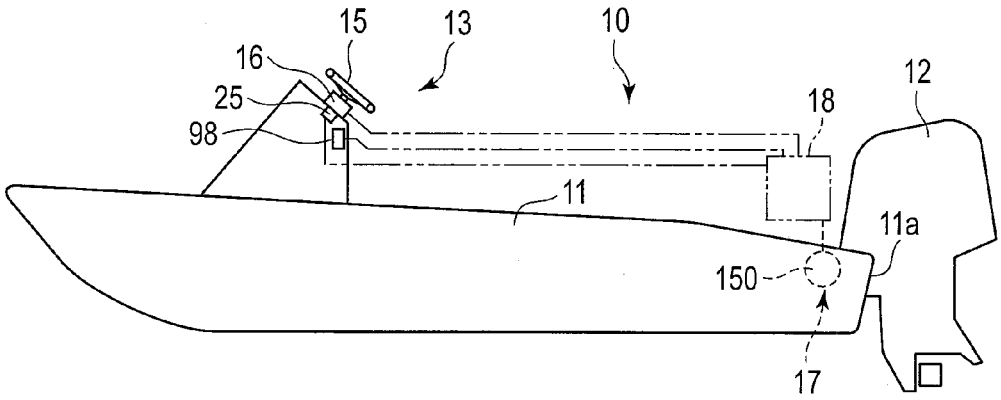
FIG. 1 is a side view of a boat comprising a helm device.
Figure 2:
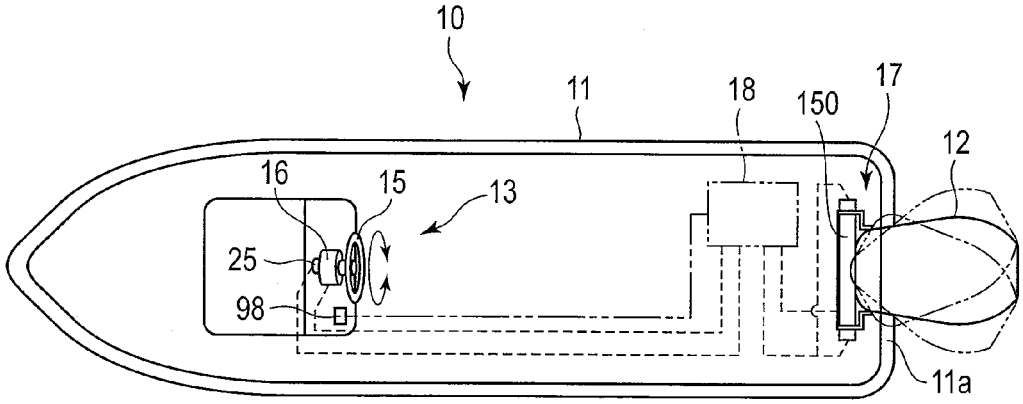
FIG. 2 is a plan view of the boat shown in FIG. 1.

FIGS. 1 and 2 illustrate an example of a boat 10. The boat 10 comprises a hull 11, an outboard motor 12, and a steering apparatus 13. The steering apparatus 13 comprises a helm device 16 comprising a steering wheel 15, an electric actuator unit 17 configured to change a steering angle of the outboard motor 12, and a control unit 18. The control unit 18 is electrically connected to the helm device 16 and the actuator unit 17.

Figure 3:
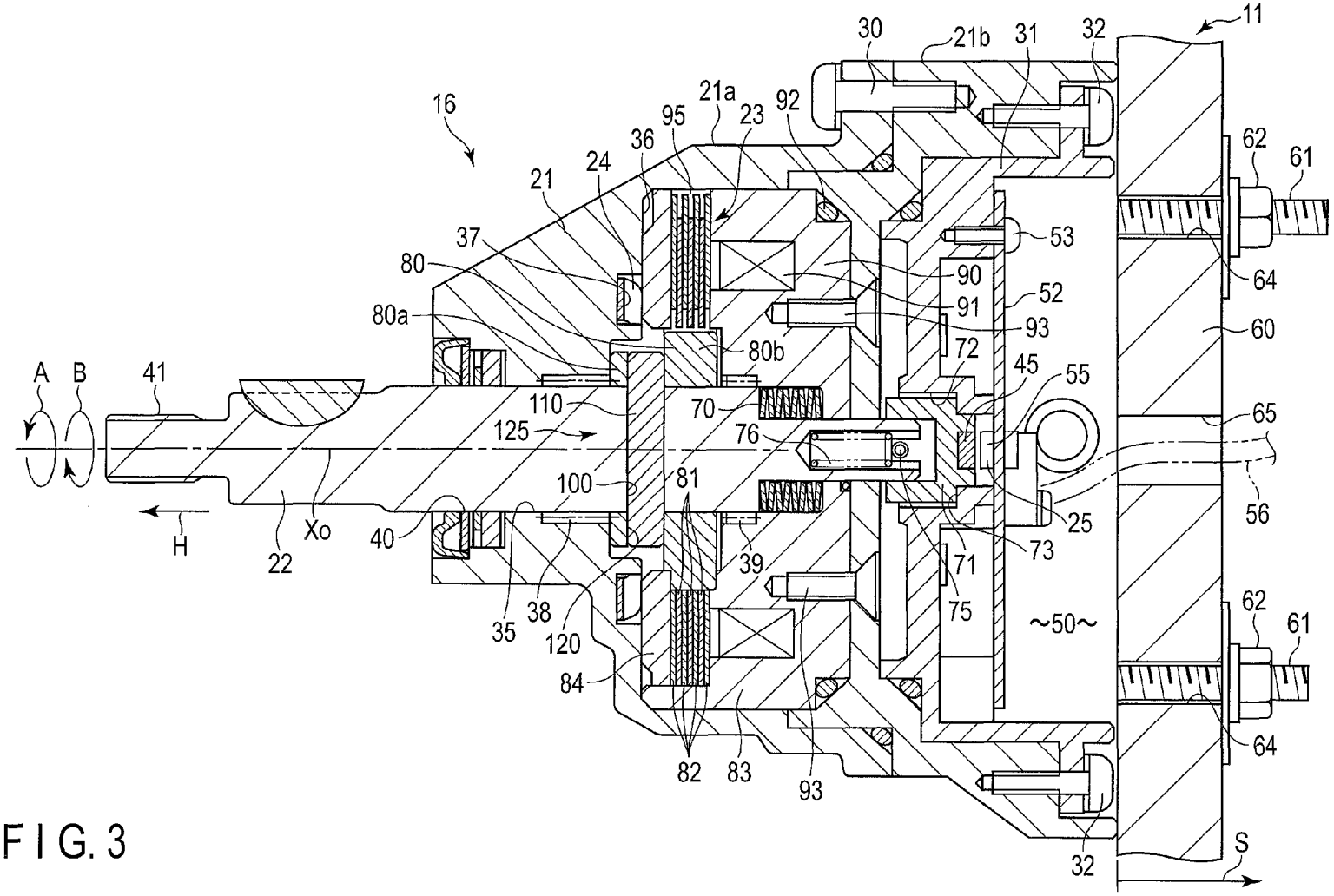
FIG. 3 is a cross-sectional view of the helm device according to a first embodiment.

FIG. 3 is a cross-sectional view showing an example of the helm device 16. The helm device 16 comprises a waterproof case 21, a steering shaft 22 inserted in the case 21, a stop mechanism 23 provided within the case 21, an assist spring 24, a sensor (helm sensor) 25 for detecting rotation of the steering shaft 22, etc.

The case 21 comprises a first case member 21*a* and a second case member 21*b*. The second case member 21*b* is secured to the first case member 21*a* by a fixing member 30. A cover member 31 is inserted into the second case member 21*b*. The cover member 31 is secured to the second case member 21*b* by fixing members 32.

In the first case member 21*a*, a hole 35 into which the steering shaft 22 is inserted, a chamber 36 that accommodates the stop mechanism 23, a spring receiving surface 37 supporting the assist spring 24 are formed. Oil is filled into the chamber 36. The stop mechanism 23 is immersed in this oil. The steering shaft 22 is rotatably supported by bearing members 38 and 39, and can be rotated in first direction A and second direction B about axis $X_0$ (FIG. 3). A seal member 40 is provided between the steering shaft 22 and an inner peripheral surface of the hole 35.

One of end portions of the steering shaft 22 is projected outward from the case 21. On this end portion of the steering shaft 22, a fitting portion 41 is formed. The steering wheel 15 is secured to the fitting portion 41. The other end portion of the steering shaft 22 is positioned inside the case 21. A magnet 45 for use as a member to be detected that constitutes a part of the sensor 25 is disposed on the other end portion.

A circuit board 52 is accommodated in a recess 50 formed in the cover member 31. The circuit board 52 is secured to the cover member 31 by a fixing member 53. An element 55 for detecting the magnet 45 is disposed on the circuit board 52. The magnet 45 and the element 55 constitute the sensor (helm sensor) 25 for detecting the degree of rotation and the direction of rotation of the steering shaft 22. An electrical signal concerning the manipulated variable (operating angle) of the steering shaft 22 detected by the sensor 25 is output to the control unit 18 via a conducting member 56.

As shown in FIG. 3, the case 21 is secured to a helm mounting wall 60, which is a part of the hull 11, by means of a mounting bolt 61 and a nut 62. The mounting bolt 61 is provided in the case 21. The mounting bolt 61 projects from an end surface 63 of the case 21 into area S of the hull. The mounting bolt 61 is inserted into a through-hole 64 formed in the helm mounting wall 60. In the helm mounting wall 60, a through-hole 65 for passing through the conducting member 56 is formed.

An elastic member 70 formed of, for example, a disc spring, is disposed near the end portion of the steering shaft 22 positioned inside the case 21. The steering shaft 22 is urged in the direction of projecting outward from the case 21 (i.e., the direction indicated by arrow H in FIG. 3) by the elastic member 70. The elastic member 70 also has the function of absorbing vibration, etc., in the direction of axis $X_0$ of the steering shaft 22 since the elastic member 70 deforms when it is subjected to a load input in the direction of axis $X_0$.

At the end portion of the steering shaft 22 positioned inside the case 21, a holder member 71 is provided. The holder member 71 is inserted into a recess 72 formed in a central part of the cover member 31. The holder member 71 is supported to be rotatable about axis $X_0$ of the steering shaft 22 by a support base 73.

On an end surface of the holder member 71, the magnet 45, which is an example of a member to be detected, is provided. The magnet 45 is located on an extended line of axis $X_0$ of the steering shaft 22. On the circuit board 52, the sensor 25 comprising the element 55 is disposed. The element 55 of the sensor 25 detects a rotational position of the steering shaft 22 by magnetic force produced by the magnet 45.

The holder member 71 is provided with a pin 75. The pin 75 extends in a radial direction of the holder member 71. The steering shaft 22 and the holder member 71 are connected to each other by the pin 75. The holder member 71 can be rotated with the steering shaft 22. Moreover, the holder member 71 is movable relative to the steering shaft 22 in the direction of axis $X_0$.

In the end portion of the steering shaft 22, a spring 76 formed of, for example, a compression coil spring is accommodated. The holder member 71 is constantly urged toward the sensor 25 from the steering shaft 22 by the spring 76. Accordingly, the holder 71 is maintained such that its position relative to the sensor 25 in the direction of axis $X_0$ is constant regardless of the position of the steering shaft 22 in the direction of axis $X_0$. For this reason, even if the position of the steering shaft 22 is shifted in the direction of axis $X_0$, a distance from the member to be detected (the magnet 31) to the sensor 25 can be kept constant. Accordingly, the sensor 25 can constantly output stable signals.

Figure 4:
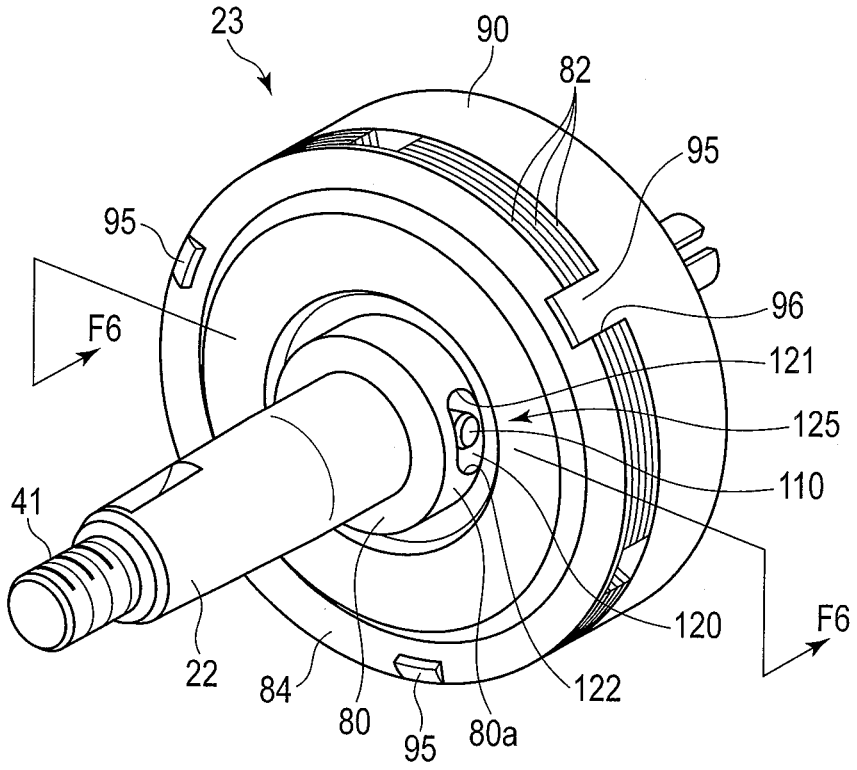
FIG. 4 is a perspective view showing a stop mechanism of the helm device shown in FIG. 3.
Figure 5:
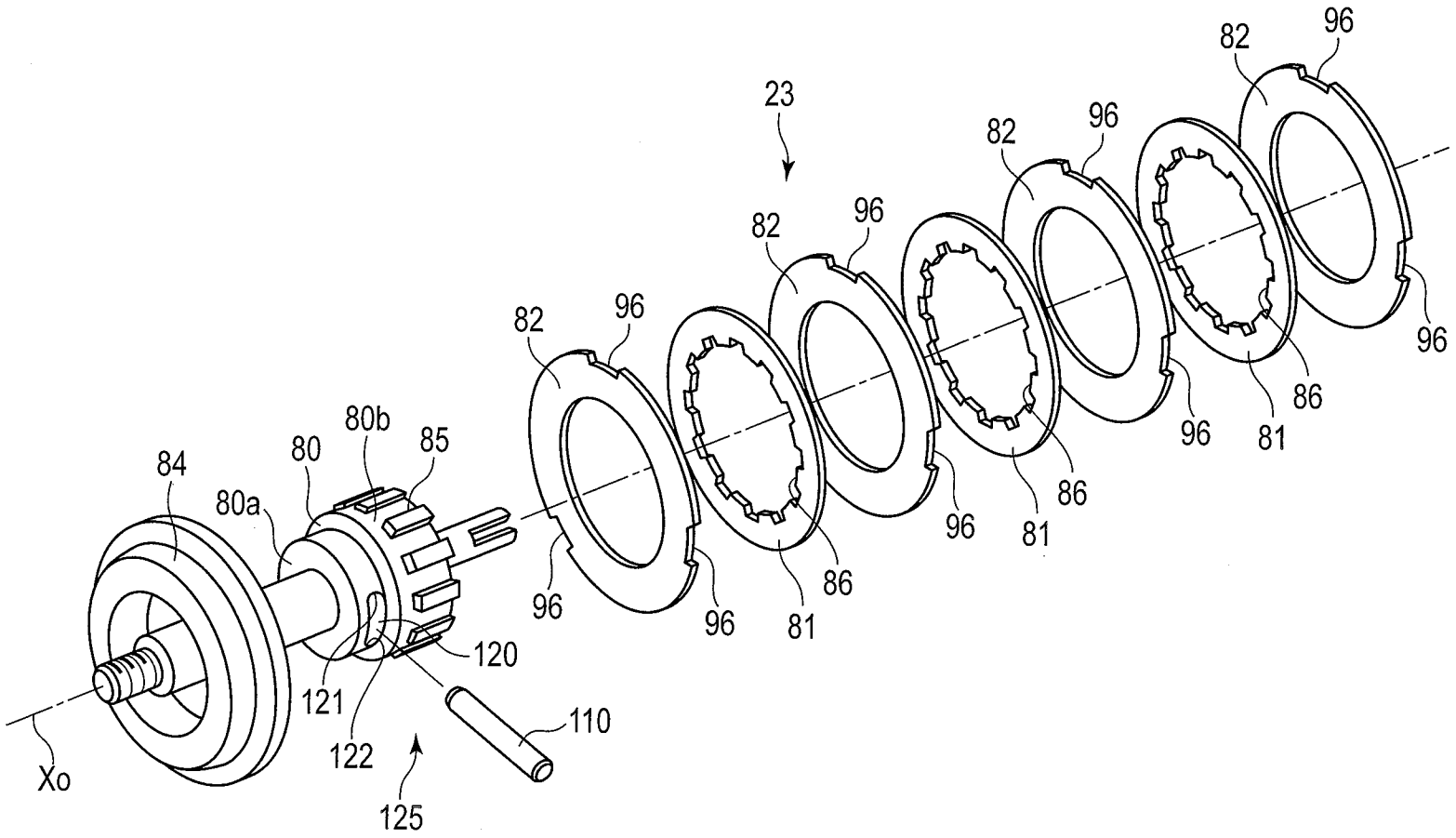
FIG. 5 is an exploded perspective view of the stop mechanism of the helm device shown in FIG. 3.
Figure 6:
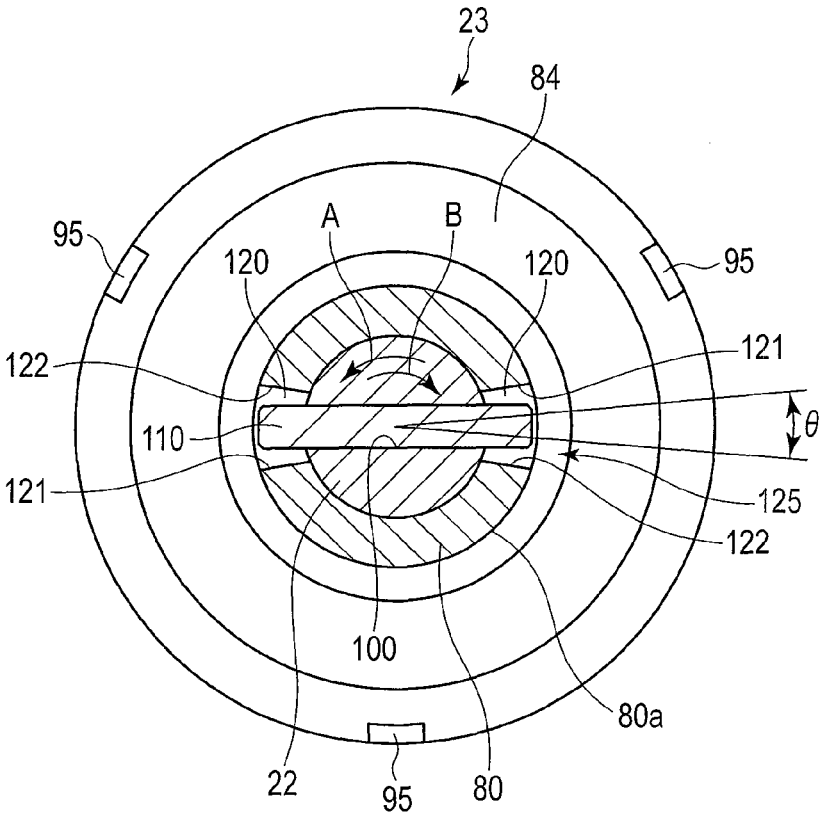
FIG. 6 is a cross-sectional view of the stop mechanism taken along line F6-F6 of FIG. 4.
Figure 7:
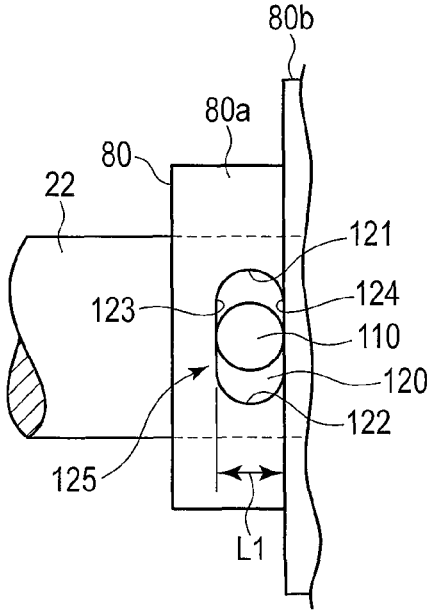
FIG. 7 is a side view of a part of the helm device.

The stop mechanism 23 is accommodated in the chamber 36 of the case 21. FIG. 4 is a perspective view of the stop mechanism 23, and FIG. 5 is an exploded perspective view showing a part of the stop mechanism 23. FIG. 6 is a cross-sectional view taken along line F6-F6 of FIG. 4, and FIG. 7 is a partial side view of the stop mechanism 23.

The stop mechanism 23 comprises a rotation member 80 attached to the steering shaft 22, a plurality of rotatable disks 81 which rotate together with the rotation member 80, a plurality of fixed disks 82 arranged to be opposed to the rotatable disks 81, an electromagnet 83, and an armature 84. The rotatable disks 81 and the fixed disks 82 are alternately arranged in a through-thickness direction. The stop mechanism 23 is in contact with the oil filled in the chamber 36. The rotation member 80 is allowed to perform relative rotation with respect to the steering shaft 22 within the range of inversion allowance angle θ by an inversion control pin mechanism 125 which will be described later in detail.

The rotation member 80 comprises a cylindrical portion 80*a*, and a disk mounting portion 80*b* having a larger diameter than the cylindrical portion 80*a*. On an outer peripheral surface of the disk mounting portion 80*b*, splines 85 along axis $X_0$ are formed. On an inner peripheral portion of each rotatable disk 81, tooth portions 86 which engage with the splines 85 are formed. Consequently, the rotatable disks 81 are held to be movable on the rotation member 80 in the direction of axis $X_0$, and can also rotate integrally with the rotation member 80.

The electromagnet 83 comprises a yoke 90 and a coil 91. Electric power from a power source not shown is supplied to the coil 91 through the control unit 18. A seal member 92 is provided between an outer peripheral surface of the yoke 90 and an inner peripheral surface of the case 21. The armature 84 is movable in a direction along axis $X_0$ of the steering shaft 22. The armature 84 is attracted to the yoke 90 by magnetic force produced when electric power is supplied to the coil 91. That is, the armature 84 can be moved in the direction of pressing the rotatable disks 81 and the fixed disks 82 against one another.

The yoke 90 is secured to the case 21 by fixing members 93. On the outer peripheral portion of the yoke 90, a protrusion 95 is formed. A recess 96 formed on an outer peripheral portion of each of the fixed disks 82 engages with the protrusion 95. That is, the fixed disks 82 held by the yoke 90 such that they are movable relative to the case 21 in the direction of axis $X_0$ of the steering shaft 22, and they do not rotate relative to the case 21.

The assist spring 24 is positioned between the spring receiving surface 37 of the case 21 and the armature 84 in such a state that the spring 24 is deformed by application of an initial load. By a repulsive load produced by the assist spring 24, the armature 84 is constantly urged toward the yoke 90.

The electromagnet 83 attracts the armature 84 only when electric power is supplied to the coil 91. In other words, when the electromagnet 83 is not energized, the rotatable disks 81 and the fixed disks 82 are sandwiched between the armature 84 and the yoke 90 by the repulsive load of the assist spring 24 and produce frictional force (friction).

The electromagnet 83 produces magnetic force according to the magnitude of electric power supplied to the coil 91, thereby attracting the armature 84. Accordingly, when the electromagnet 83 is energized, the rotatable disks 81 and the fixed disks 82 are sandwiched between the armature 84 and the yoke 90 by force obtained by adding the repulsive load of the assist spring 24 and attractive force of the electromagnet 83. That is, according to the magnitude of electric power supplied to the electromagnet 83, frictional force of the stop mechanism 23 can be varied. Consequently, steering effort on the steering wheel 15 (resistance) can be varied.

In the control unit 18, a computer program capable of changing electric power to be supplied to the coil 91 depending on the boat operator's desire or boat handling conditions is installed. For example, by operating an adjustment operation portion 98 arranged near a helm position (steering seat) of the boat 10, electric power to be supplied to the electromagnet 83 can be varied.

When the resistance (steering effort) in operating the steering wheel 15 is to be increased, the adjustment operation portion 98 is operated in the direction of "high friction". In that case, the electric power supplied to the electromagnet 83 is increased, thereby increasing the magnetic field of the electromagnet 83. Accordingly, as the armature 84 is attracted with greater force, friction of the stop mechanism 23 is increased. Thus, the steering effort can be increased. When the steering effort is to be reduced, the adjustment operation portion 98 is operated in the direction of "low friction". In that case, the electric power supplied to the electromagnet 83 is reduced and the magnetic field of the electromagnet 83 is reduced, so that steering effort is reduced as the friction of the stop mechanism 23 is reduced.

Also, the control unit 18 has the function of locking the steering shaft 22 so that the steering wheel 15 does not turn further than the maximum steering angle when it is turned to the maximum steering angle from the neutral position. That is, when the steering wheel 15 is turned to the maximum to the starboard or the port side up to the number of steering wheel turns, the control unit 18 controls the electric power supplied to the electromagnet 83 to be maximum, and the magnetic field of the electromagnet 83 to be maximum. Accordingly, the rotatable disks 81 and the fixed disks 82 are locked to one other. The steering wheel 15 is thereby brought into a locked state, and prevented from being turned further. That is, the control unit 18 is equipped with a computer program as the means for supplying the electromagnet 83 with electric power which locks the disks 81 and 82 with one another when the number of turns of the steering wheel 15 (the amount of turn from the neutral position) reaches the preset number of steering wheel turns.

As shown in FIGS. 3 to 7, a radial through-hole 100 is formed in the steering shaft 22. Further, an inversion control pin 110 is inserted into the through-hole 100. The inversion control pin 110 may be secured to the steering shaft 22 by, for example, being inserted into the through-hole 100 by press-fit. Both ends of the inversion control pin 110 protrude in a radial direction of the steering shaft 22 from an outer peripheral surface of the steering shaft 22.

The rotation member 80 comprises the cylindrical portion 80*a* and the disk mounting portion 80*b*. The rotation member 80 can be relatively rotated with respect to the steering shaft 22 in a circumferential direction about axis $X_0$. In the rotation member 80, a pair of slits 120 is formed in symmetrical positions under a 180-degree rotation in a circumferential direction of the cylindrical portion 80*a*. These slits 120 are shaped to be elongated in the circumferential direction of the cylindrical portion 80*a*, and have elongated circular shapes as seen from a side surface of the cylindrical portion 80*a*. At one end of each of the slits 120 in the circumferential direction, a first pin receiving stopper wall 121 is formed. At the other end of each of the slits 120 in the circumferential direction, a second pin receiving stopper wall 122 is formed.

The pin receiving stopper walls 121 and 122 are formed into semicircular shapes, respectively, corresponding to the shape (circular shape) of the outer peripheral surface of the inversion control pin 110 having a cylindrical form. Distance L1 (FIG. 7) between inner surfaces 123 and 124 of each of the slits 120 is set to be slightly larger than the outer diameter of the inversion control pin 110. In this way, the inversion control pin 110 is prevented from moving in the direction of axis $X_0$, while being allowed to move in the circumferential direction.

The inversion control pin 110 extends in the radial direction of the steering shaft 22 and the cylindrical portion 80*a*. The inversion control pin 110 extends through the steering shaft 22 and the cylindrical portion 80*a*. In a pair of slits 120, both ends of the inversion control pin 110 are inserted to be movable in the circumferential direction. The inversion control pin 110 can be moved within the range of inversion allowance angle θ between the first and the second pin receiving stopper walls 121 and 122. Thus, the rotation member 80 can be relatively rotated with respect to the steering shaft 22 within the range of inversion allowance angle θ. Inversion allowance angle θ is greater than the minimum detection angle detectable by the sensor 25. The inversion control pin 110, the slits 120 having the inner surfaces 123 and 124, the first and second pin receiving stopper walls 121 and 122, etc., constitute the inversion control pin mechanism 125.

Next, the actuator unit 17 will be described.

Figure 8:
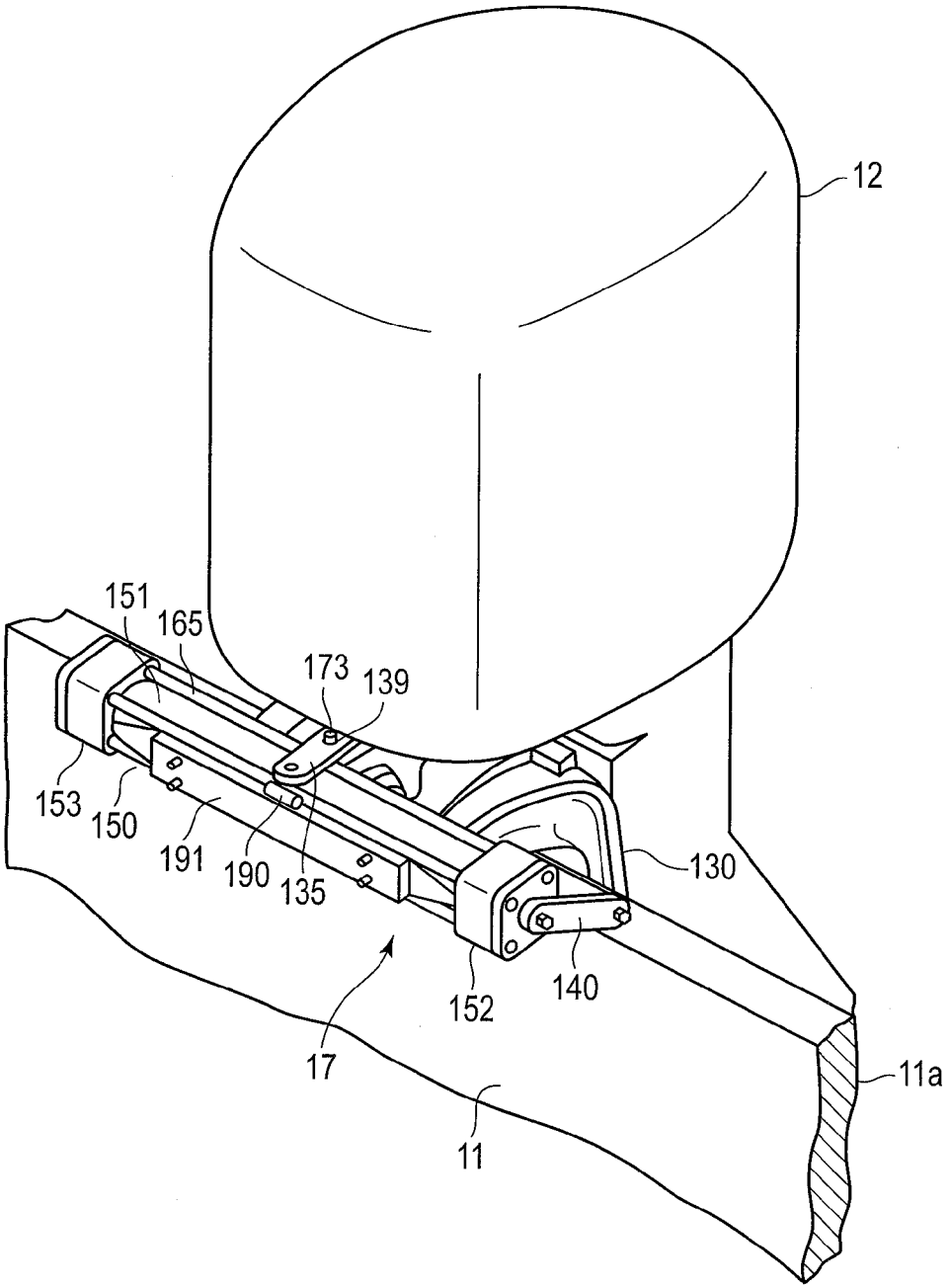
FIG. 8 is a perspective view showing a part of an outboard motor and an actuator unit of the boat shown in FIG. 1.
Figure 9:
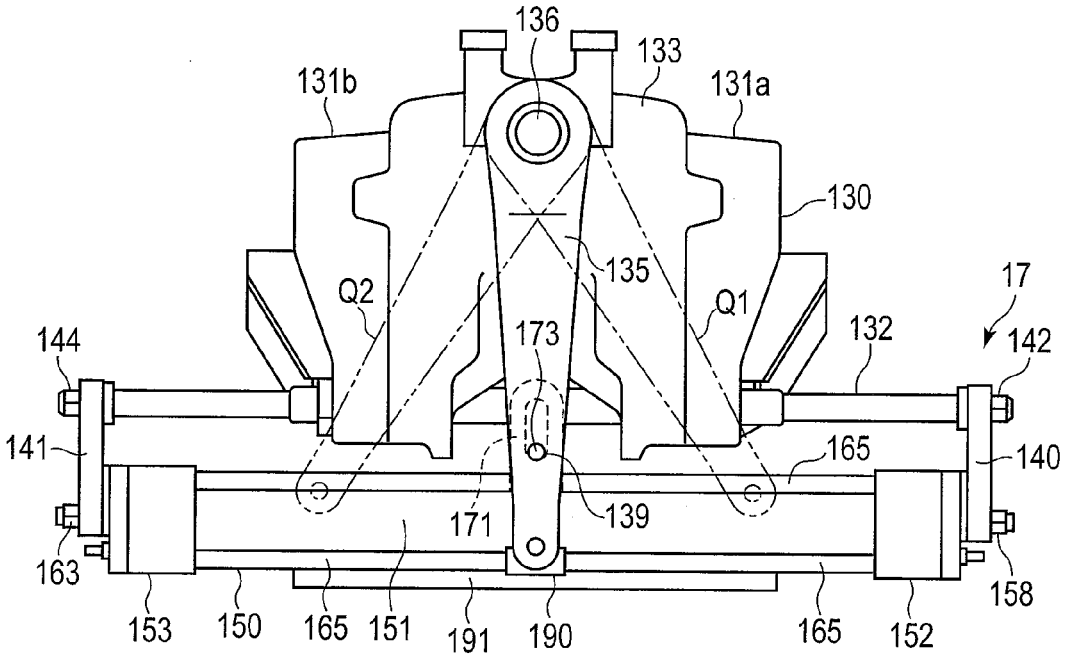
FIG. 9 is a plan view of the actuator unit and a bracket shown in FIG. 8.

FIG. 8 shows a part of the outboard motor 12 and the actuator unit 17. The outboard motor 12 is supported on a rear wall 11*a* of the hull 11 by a bracket 130. FIG. 9 is a plan view of the actuator unit 17 and the bracket 130 as seen from above.

The bracket 130 comprises fixed bracket portions 131*a* and 131*b* secured to the hull 11, and a movable bracket portion 133. The movable bracket portion 133 is movable upward and downward about a rotation axis 132 relative to the fixed bracket portions 131*a* and 131*b*. An example of the rotation axis 132 is a tilt axis which serves as the center when tilting up the outboard motor 12, and the rotation axis 132 extends transversely, that is, horizontally, relative to the hull 11.

The outboard motor 12 is mounted on the movable bracket portion 133. The movable bracket portion 133 can be moved upward and downward between a tilt-down position and a tilt-up position by a tilt drive force such as a hydraulic actuator not shown. That is, the outboard motor 12 has a tilt-up function.

The movable bracket portion 133 is provided with a steering arm 135 for changing a steering direction of the outboard motor 12. The steering arm 135 can be pivoted laterally (left and right) about a pivot 136 (FIG. 9) provided on the movable bracket portion 133. By moving the steering arm 135 laterally, the outboard motor 12 can be moved in the starboard direction or the port direction with respect to the hull 11.

FIG. 9 shows the state in which the steering arm 135 is in the neutral position. When the steering arm 135 is in the neutral position, since the outboard 12 is in the neutral position at which the steering angle is zero, the boat 10 proceeds straight. As shown by two-dot chain lines Q1 and Q2 in FIG. 9, the steering arm 135 can be moved in the starboard direction or the port direction. A receiving portion 139 formed of, for example, a hole, is provided near a distal end portion of the steering arm 135.

The actuator unit 17 comprises a first support arm 140 and a second support arm 141. The first support arm 140 is secured to one end of the rotation axis (tilt axis) 132 by a fastener 142 such as a nut. The second support arm 141 is secured to the other end of the rotation axis 132 by a fastener 144 such as a nut.

Figure 10:
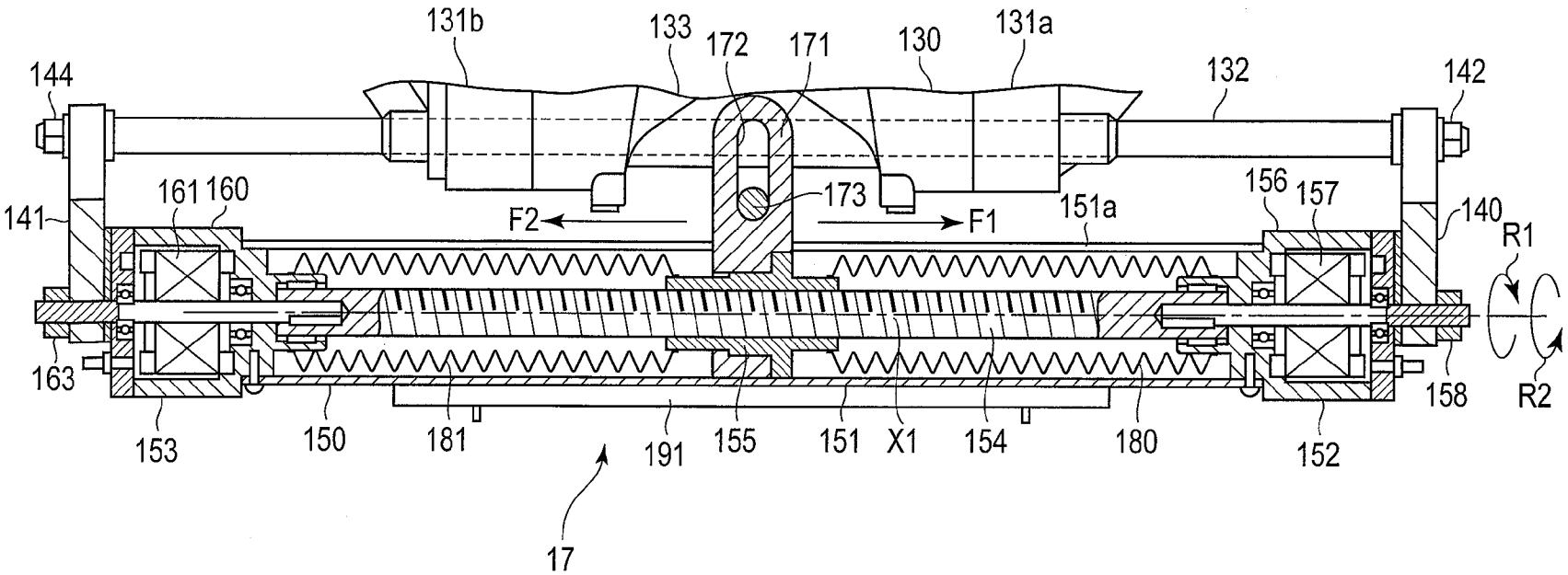
FIG. 10 is a cross-sectional view taken along an axial direction of the actuator unit shown in FIG. 8.

The actuator unit 17 comprises an electric actuator 150. The electric actuator 150 is secured to both ends of the rotation axis 132 via the first and the second support arms 140 and 141. FIG. 10 is a cross-sectional view taken along an axial direction of the electric actuator 150. The electric actuator 150 comprises a cylindrical cover member 151, a first electric motor 152, a second electric motor 153, a feed screw 154, a nut member 155, etc. The cover member 151 extends transversely relative to the hull 11. The first electric motor 152 is mounted on one end of the cover member 151. The second electric motor 153 is mounted on the other end of the cover member 151. The feed screw 154 rotates by the electric motors 152 and 153. A slit 151*a* is formed in the cover member 151 along axis X1.

The first electric motor 152 comprises a motor body 156 and a rotor 157 configured to rotate by electric power. The motor body 156 is secured to the first support arm 140 by a fastener 158 such as a nut. The second electric motor 153 comprises a motor body 160 and a rotor 161 configured to rotate by electric power. The motor body 160 is secured to the second support arm 141 by a fastener 163 such as a nut. As the electric motors 152 and 153 rotate in the same direction in synchronization with each other, torques can be applied to the feed screw 154 from both ends of the feed screw 154.

A plurality of (for example, four) connecting rods 165 are arranged parallel to one another between the motor body 156 of the first electric motor 152 and the motor body 160 of the second electric motor 153. These connecting rods 165 are disposed outside the cover member 151, and extend along axis X1 (FIG. 10) of the cover member 151. The motor body 156 of the first electric motor 152 and the motor body 160 of the second electric motor 153 are connected to each other by these connecting rods 165.

The feed screw 154 is arranged inside the cover member 151. The feed screw 154 is disposed along axis X1 of the cover member 151. The feed screw 154 can be rotated in first direction R1 and second direction R2 (FIG. 10) by the torques produced by the first electric motor 152 and the second electric motor 153.

The nut member 155 is accommodated within the cover member 151. The nut member 155 is threadably mounted on the feed screw 154 to be rotatatable. When the feed screw 154 is relatively rotated with respect to the nut member 155, the nut member 155 reciprocate in first direction F1 or second direction F2 (FIG. 10) along axis X1 within the cover member 151.

The nut member 155 is provided with a drive arm 171. The drive arm 171 moves integrally with the nut member 155 in first direction F1 or second direction F2 along the slit 151*a*. A long hole 172 is formed in the drive arm 171. An engagement member 173 is inserted into the long hole 172. The engagement member 173 is movable longitudinally relative to the drive arm 171 along the long hole 172, but its lateral movement is restricted.

The engagement member 173 is connected to the receiving portion 139 of the steering arm 135. When the drive arm 171 is moved in first direction F1 or second direction F2, the engagement member 173 is moved in the same direction as the drive arm 171. As a result, the steering arm 135 is moved in the starboard direction or the port direction. The feed screw 154 is covered by protective boots 180 and 181 which can expand and contract in the direction of axis X1.

The actuator unit 17 comprises a neutral position detection sensor 190, and a steering angle sensor 191. The neutral position detection sensor 190 has the function of detecting whether the steering arm 135 is in the neutral position. The steering sensor 191 has the function of detecting the steering angle of the steering arm 135. When the steering arm 135 is in the neutral position, a signal indicative of the neutral position is output from the neutral position detection sensor 190 to the control unit 18.

In the following, an action of the steering apparatus 13 comprising the helm device 16 and the actuator unit 17 will be described.

When the steering wheel 15 is turned, the degree of rotation (steering angle) of the steering wheel 15 is detected by the sensor 25, and electrical signals regarding the direction of steering and the magnitude of the steering angle are transmitted to the control unit 18. The control unit 18 rotates the first and the second electric motors 152 and 153 such that a target steering angle output from the sensor 25 to the control unit 18 agrees with the actual steering angle of the outboard motor 12 detected by the steering angle sensor 191.

When the motors 152 and 153 rotate in the same direction, the torques of the motors 152 and 153 are input to the feed screw 154 from both ends of the feed screw 154. When the feed screw 154 rotates, the nut member 155 and the drive arm 171 move in first direction F1 or second direction F2 (FIG. 10) along axis X1 of the cover member 151 in accordance with the degree of rotation and the direction of rotation of the feed screw 154.

A position of the nut member 155, that is, the steering angle of the steering arm 135, is detected by the steering angle sensor 191. The control unit 18 assumes the neutral position of the steering arm 135 detected by the neutral position detection sensor 190 as a reference position in the steering angle. Further, the control unit 18 controls the electric motors 152 and 153 such that the actual steering angle of the steering arm 135 detected by the steering angle sensor 191 agrees with the output (target steering angle) of the steering wheel 15.

For example, when the steering wheel 15 is steered in the starboard direction, the motors 152 and 153 rotate in first direction R1 (FIG. 10). Accordingly, the drive arm 171 is moved in first direction F1, and the steering arm 135 is moved toward a starboard position shown as Q1 in FIG. 9. When the steering angle detected by the steering angle sensor 191 reaches the target steering angle, the motors 152 and 153 stop and the drive arm 171 also stops.

Conversely, when the steering wheel 15 is steered in the port direction, the motors 152 and 153 rotate in second direction R2. Accordingly, the drive arm 171 is moved in second direction F2 (FIG. 10), and the steering arm 135 is moved toward a port position shown as Q2 in FIG. 9. When the steering angle detected by the steering angle sensor 191 reaches the target steering angle, the motors 152 and 153 stop and the drive arm 171 also stops.

According to the steering apparatus 13 of the present embodiment, the electromagnet 83 of the stop mechanism 23 which is provided in the helm device 16 is controlled by the control unit 18. Further, as the boat operator operates the adjustment operation portion 98, control force on the steering wheel 15 (resistance) can be adjusted. Also, by automatically controlling the electromagnet 83 based on signals from various sensors input to the control unit 18, the helm device 16 can be adjusted to provide a suitable state for boat handling conditions.

In steering, when the steering shaft 22 is rotated in first direction A (FIGS. 3 and 6) by the steering wheel 15, the inversion control pin 110 contacts the first pin receiving stopper wall 121. Accordingly, the rotation member 80 rotates integrally with the steering shaft 22 in first direction A. At this time, the inversion control pin 110 is separated from the second pin receiving stopper wall 122 by an angle which is greater than or equal to the minimum detection angle detectable by the sensor 25. When the steering wheel 15 is turned to a maximum steering angle position in first direction A, the control unit 18 maximizes the electric power to be supplied to the electromagnet 83. Thus, the disks 81 and 82 are locked to one other. In this locked state, when the steering wheel 15 is turned (reversed) to the opposite side, the steering shaft 22 can be reversed within the inversion allowance angle 9 of the inversion control pin 110. The movement in the reverse direction is detected by the sensor 25. At this time, the control unit 18 cancels the locking of the stop mechanism 23 based on a signal from the sensor 25. The steering wheel 15 can thereby be turned in the opposite direction.

When the steering shaft 22 is rotated in second direction B (FIGS. 3 and 6) by the steering wheel 15, the inversion control pin 110 contacts the second pin receiving stopper wall 122. Accordingly, the rotation member 80 rotates integrally with the steering shaft 22 in second direction B. At this time, the inversion control pin 110 is separated from the first pin receiving stopper wall 121 by an angle which is greater than or equal to the minimum detection angle detectable by the sensor 25. When the steering wheel 15 is turned to a maximum steering angle position in second direction B, the control unit 18 maximizes the electric power to be supplied to the electromagnet 83. Thus, the disks 81 and 82 are locked to one other. In this locked state, when the steering wheel 15 is turned (reversed) to the opposite side, the steering shaft 22 can be reversed within the inversion allowance angle θ of the inversion control pin 110. The movement in the reverse direction is detected by the sensor 25. At this time, the control unit 18 cancels the locking of the stop mechanism 23 based on a signal from the sensor 25. The steering wheel 15 can thereby be turned in the opposite direction.

As described above, since the inversion control pin 110 can move between the first pin receiving stopper wall 121 and the second pin receiving stopper wall 122 inside the slit 120, the steering shaft 22 can be relatively rotated with respect to the rotation member 80 within the range of inversion allowance angle θ. Accordingly, even in a state where the disks 81 and 82 are locked to one another by the electromagnet 83 at the maximum steering angle position, the steering shaft 22 can rotate in the opposite direction within the range of inversion allowance angle θ exceeding the minimum detection angle (the detection resolution) of the sensor 25. Thus, the sensor 25 can output a signal for cancelling the locking. The inversion allowance angle θ can be easily adjusted by changing the diameter (thickness) of the inversion control pin 110, or changing the distance between the pin receiving stopper walls 121 and 122.

Figure 11:
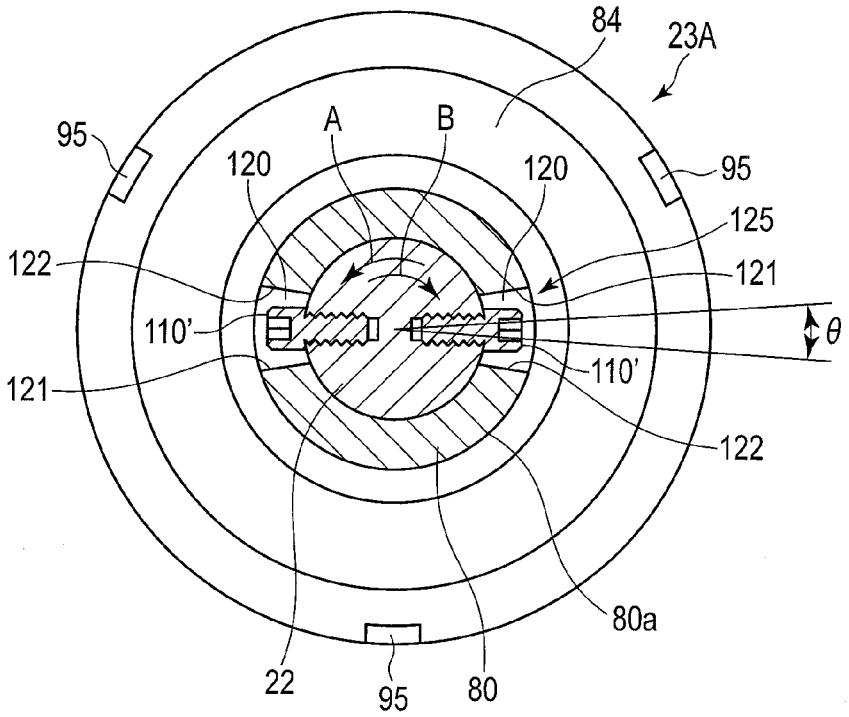
FIG. 11 is a cross-sectional view of a part of a helm device according to a second embodiment.

FIG. 11 illustrates a stop mechanism 23A according to a second embodiment. In this stop mechanism 23A, for parts which are in common with the parts of the stop mechanism 23 (FIGS. 3 to 7) of the first embodiment, the same reference numbers as those of the stop mechanism 23 of the first embodiment are added, and explanations of them are omitted. An inversion control pin mechanism 125 of the stop mechanism 23A comprises a pair of inversion control pins 110' each formed of a screw member. These inversion control pins 110' are screwed into both sides of a steering shaft 22 to be secured. A pair of slits 120 is formed in a cylindrical portion 80*a* of a rotation member 80. In each of the slits 120, a first pin receiving stopper wall 121 and a second pin receiving stopper wall 122 are formed. The inversion control pins 110' are inserted into the slits 120, respectively. The steering shaft 22 can be relatively rotated with respect to the rotation member 80 within the range of inversion allowance angle θ.

Figure 12:
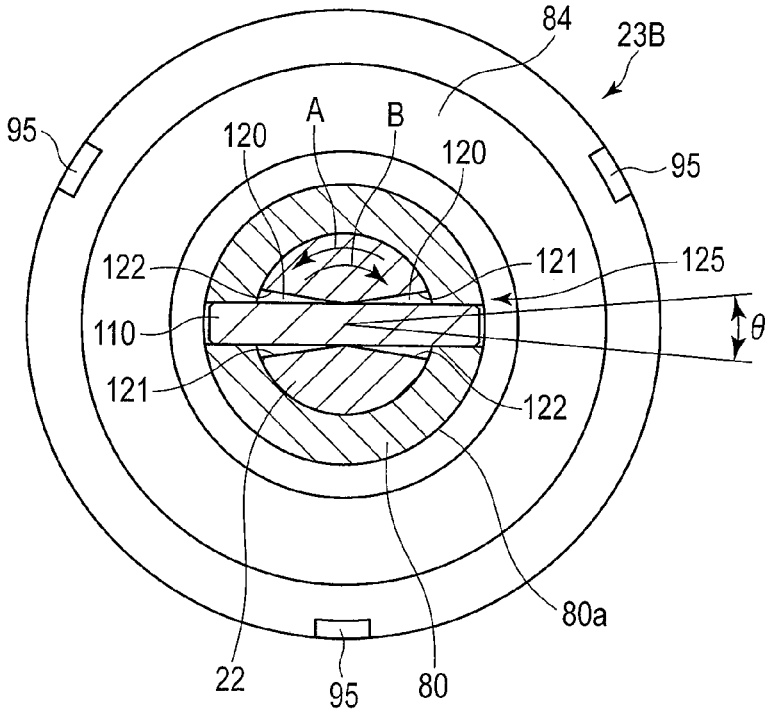
FIG. 12 is a cross-sectional view of a part of a helm device according to a third embodiment.

FIG. 12 illustrates a stop mechanism 23B according to a third embodiment. In this stop mechanism 23B, for parts which are in common with the parts of the stop mechanism 23 (FIGS. 3 to 7) of the first embodiment, the same reference numbers as those of the stop mechanism 23 of the first embodiment are added, and explanations of them are omitted. An inversion control pin 110 of the stop mechanism 23B is secured to a cylindrical portion 80*a* of a rotation member 80. A slit 120 into which the inversion control pin 110 is inserted is formed in a steering shaft 22. At both ends of the slit 120, first and second pin receiving stopper walls 121 and 122 are formed. The steering shaft 22 can be relatively rotated with respect to the rotation member 80 within the range of inversion allowance angle θ.

Figure 13:
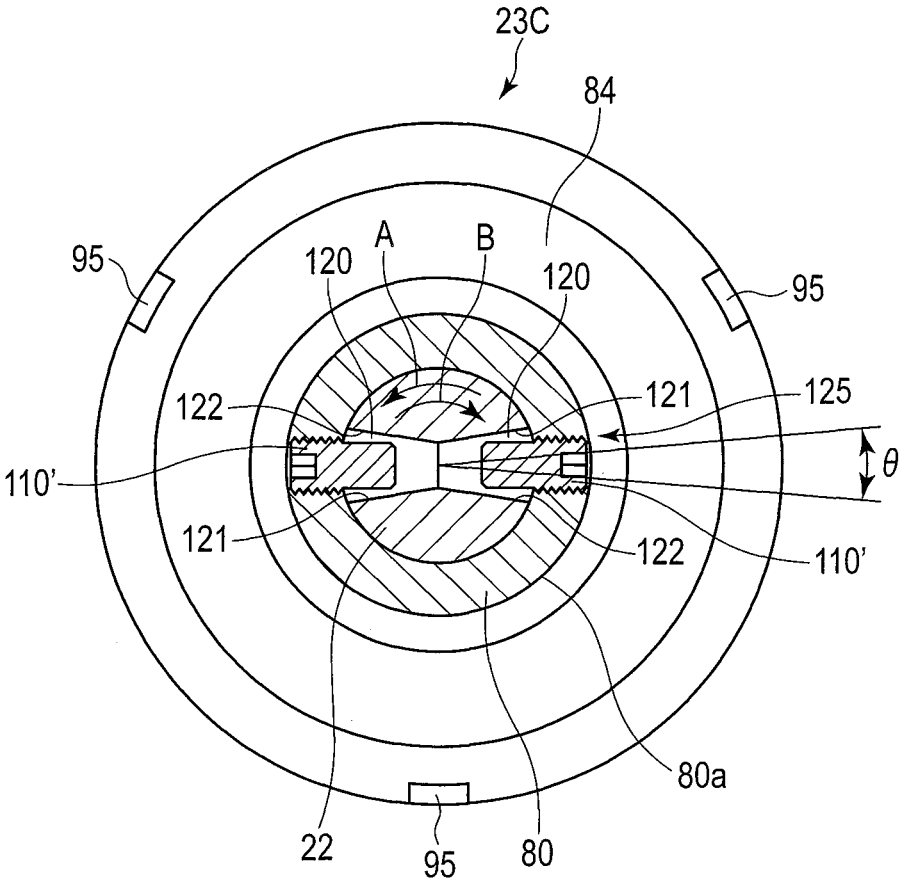
FIG. 13 is a cross-sectional view of a part of a helm device according to a fourth embodiment.

FIG. 13 illustrates a stop mechanism 23C according to a fourth embodiment. In this stop mechanism 23C, for parts which are in common with the parts of the stop mechanism 23 (FIGS. 3 to 7) of the first embodiment, the same reference numbers as those of the stop mechanism 23 of the first embodiment are added, and explanations of them are omitted. An inversion control pin mechanism 125 of the stop mechanism 23C comprises a pair of inversion control pins 110' each formed of a screw member. These inversion control pins 110' are secured by being screwed into both sides of a cylindrical portion 80*a* of a rotation member 80. A pair of slits 120 is formed in a steering shaft 22. In each of the slits 120, a first pin receiving stopper wall 121 and a second pin receiving stopper wall 122 are formed. The inversion control pins 110' are inserted into the slits 120, respectively. The steering shaft 22 can be relatively rotated with respect to the rotation member 80 within the range of inversion allowance angle θ.

Needless to say, in implementing the present invention, the structure, shape, and arrangement of each member which constitutes the helm device, such as the case or the steering shaft of the helm device, and the disks, electromagnet, inversion control pin, slit, and first and second pin receiving stopper walls of the stop mechanism, may be modified variously.

The present invention can be applied to not only a helm device for use in steering a boat, but also an electric helm device for various apparatuses comprising a steering apparatus.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A helm device of a boat comprising:

a case secured to a hull;

a steering shaft which is rotatably arranged in the case and on which a steering wheel is mounted;

a sensor configured to detect rotation of the steering shaft; and a stop mechanism configured to stop rotation of the steering shaft when the steering wheel is turned to a maximum steering angle, the stop mechanism comprising:

a cylindrical portion which is relatively rotatable with respect to the steering shaft in a circumferential direction;

an inversion control pin which is provided in a radial direction of the steering shaft, extending through both the cylindrical portion and the steering shaft, the inversion control pin being secured to one of the steering shaft and the cylindrical portion;

a slit which is formed in the other one of the steering shaft and the cylindrical portion, and through which the inversion control pin is inserted to be movable in the circumferential direction;

a first pin receiving stopper wall which is formed on one end of the slit in the circumferential direction, in which when the steering shaft rotates in a first direction, the first pin receiving stopper wall contacts the inversion control pin, thereby rotating the cylindrical portion in the first direction, and when the steering shaft rotates in a second direction, the first pin receiving stopper wall is separated from the inversion control pin by an angle which is greater than or equal to a minimum detection angle detectable by the sensor; and a second pin receiving stopper wall which is formed on the other end of the slit in the circumferential direction, in which when the steering shaft rotates in the second direction, the second pin receiving stopper wall contacts the inversion control pin, thereby rotating the cylindrical portion in the second direction, and when the steering shaft rotates in the first direction, the second pin receiving stopper wall is separated from the inversion control pin by an angle which is greater than or equal to the minimum detection angle detectable by the sensor.

2. The helm device of claim 1, wherein the stop mechanism comprises:

a rotation member comprising the cylindrical portion;

a fixed disk accommodated in the case;

a rotatable disk arranged to be opposed to the fixed disk and configured to rotate together with the rotation member; and an electromagnet which produces the frictional force by pressing the fixed disk and the rotatable disk against each other.

3. The helm device of claim 1, wherein the inversion control pin is secured to the steering shaft, and the first and the second pin receiving stopper walls are formed on the cylindrical portion.

4. The helm device of claim 1, wherein the inversion control pin formed of a screw member is secured to the steering shaft, and the first and the second pin receiving stopper walls are formed on the cylindrical portion.

5. The helm device of claim 1, wherein the inversion control pin is secured to the cylindrical portion, and the first and the second pin receiving stopper walls are formed on the steering shaft.

6. The helm device of claim 1, wherein the inversion control pin formed of a screw member is secured to the cylindrical portion, and the first and the second pin receiving stopper walls are formed on the steering shaft.

* * * * *